US006238287B1

(12) United States Patent
Komori et al.

(10) Patent No.: US 6,238,287 B1
(45) **Date of Patent: *May 29, 2001**

(54) METHOD AND APPARATUS FOR INDICATING A STATUS IN A GAME MACHINE

(75) Inventors: Tomio Komori; Masahiko Haruta, both of Tokyo (JP)

(73) Assignee: Aruze Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/280,120

(22) Filed: Mar. 26, 1999

(30) Foreign Application Priority Data

Mar. 27, 1998 (JP) ..... 10-080679

(51) Int. Cl.[7] ..... A63F 9/24
(52) U.S. Cl. ..... 463/20; 273/143 R
(58) Field of Search ..... 463/20, 16, 21; 273/143 R

(56) References Cited

U.S. PATENT DOCUMENTS 4,858,932 * 8/1989 Keane ..... 273/143 R
5,152,529 * 10/1992 Okada ..... 463/20
5,423,539 * 6/1995 Nagao ..... 463/20
5,664,999 * 9/1997 Kurihara ..... 463/20
5,722,891 * 3/1998 Inoue ..... 463/20
5,833,538 * 11/1998 Weiss ..... 463/21
5,863,249 * 1/1999 Inoue ..... 463/20
5,988,638 * 11/1999 Rodesch et al. ..... 273/143 R
5,989,121 * 11/1999 Sakamoto ..... 463/20
6,024,642 * 2/2000 Stupak ..... 463/20

FOREIGN PATENT DOCUMENTS 8-280872 10/1996 (JP) .

* cited by examiner

*Primary Examiner*—Joe H. Cheng
*Assistant Examiner*—Julie Kasick
(74) *Attorney, Agent, or Firm*—Hutchins, Wheeler & Dittmar

(57) ABSTRACT

In order to provide a more interesting game machine without hindering the concentration of a player in a game, the invention relates to a game machine in which the prize patterns are decided by combinations of symbols. A regular status associated with the likelihood that an appointed prize pattern may occur is indicated by a first set of one or more combinations of symbols. A status change is being indicated by one or more combinations of symbols that are different from those one or more combinations of symbols included in the first set associated with the regular status.

11 Claims, 5 Drawing Sheets

HIGH PROBABILITY STATUS

| PRIZE PATTERNS | COMBINATIONS OF SYMBOLS | OCCURRENCE PROBABILITY |
|---|---|---|
| B.B. | SEVEN - SEVEN - SEVEN | 1/200 |
| R.B. | BAR - BAR - BAR | 1/200 |
| S.B. | MAGNUM SEVEN - MAGNUM SEVEN - MAGNUM SEVEN | 1/30 |
| | SEVEN - MAGNUM SEVEN - MAGNUM SEVEN | 1/30 |
| | SEVEN - SEVEN - MAGNUM SEVEN | 1/30 |
| | BAR - BAR - MAGNUM SEVEN | 1/30 |
| | BAR - MAGNUM SEVEN - MAGNUM SEVEN | 1/30 |
| | MAGNUM SEVEN - BAR - MAGNUM SEVEN | 1/30 |
| | MAGNUM SEVEN - SEVEN - MAGNUM SEVEN | 1/30 |
| | MAGNUM SEVEN - SEVEN - SEVEN | 1/30 |
| | MAGNUM SEVEN - MAGNUM SEVEN - SEVEN | 1/30 |
| | SEVEN - MAGNUM SEVEN - SEVEN | 1/30 |

| NAME | SYMBOLS |
| --- | --- |
| SEVEN |  |
| MAGNUM SEVEN |   |
| BAR |   |

USUAL STATUS

| PRIZE PATTERNS | COMBINATIONS OF SYMBOLS | OCCURRENCE PROBABILITY |
|---|---|---|
| B.B. | SEVEN - SEVEN - SEVEN | 1/200 |
| R.B. | BAR - BAR - BAR | 1/200 |
| S.B. | MAGNUM SEVEN - MAGNUM SEVEN - MAGNUM SEVEN | 1/30 |

FIG. 4A

HIGH PROBABILITY STATUS

| PRIZE PATTERNS | COMBINATIONS OF SYMBOLS | OCCURRENCE PROBABILITY |
|---|---|---|
| B.B. | SEVEN - SEVEN - SEVEN | 1/200 |
| R.B. | BAR - BAR - BAR | 1/200 |
| S.B. | SEVEN - MAGNUM SEVEN - MAGNUM SEVEN | 1/3 |

FIG. 4B

HIGH PROBABILITY STATUS

| PRIZE PATTERNS | COMBINATIONS OF SYMBOLS | OCCURRENCE PROBABILITY |
|---|---|---|
| B.B. | SEVEN - SEVEN - SEVEN | 1/200 |
| R.B. | BAR - BAR - BAR | 1/200 |
| S.B. | MAGNUM SEVEN - MAGNUM SEVEN - MAGNUM SEVEN | 1/30 |
| | SEVEN - MAGNUM SEVEN - MAGNUM SEVEN | 1/30 |
| | SEVEN - SEVEN - MAGNUM SEVEN | 1/30 |
| | BAR - BAR - MAGNUM SEVEN | 1/30 |
| | BAR - MAGNUM SEVEN - MAGNUM SEVEN | 1/30 |
| | MAGNUM SEVEN - BAR - MAGNUM SEVEN | 1/30 |
| | MAGNUM SEVEN - SEVEN - MAGNUM SEVEN | 1/30 |
| | MAGNUM SEVEN - SEVEN - SEVEN | 1/30 |
| | MAGNUM SEVEN - MAGNUM SEVEN - SEVEN | 1/30 |
| | SEVEN - MAGNUM SEVEN - SEVEN | 1/30 |

FIG. 5

METHOD AND APPARATUS FOR INDICATING A STATUS IN A GAME MACHINE

BACKGROUND OF THE INVENTION

The present invention relates to a game machine, and in particular to a game machine in which a prize pattern is determined by sampling a random number.

DESCRIPTION OF THE PRIOR ARTS

Conventionally, a slot machine has been favorably utilized as a game machine which pays back medals such as coins in response to the prize pattern as a result of a game. Here, a description is given of the slot machine.

A player commences a game by operating the start lever after inserting a medal into a slot machine. The slot machine is provided with a plurality of reels (for example, three reels) on which several kinds of symbols are disposed at the circumferential part, wherein an operation of the start lever causes all the reels to rotate at a high speed, and the respective reels are caused to stop by pressing stop buttons corresponding to each of the reels. The prize pattern is decided by combinations of the symbols of the respective reels which stop and are displayed in appointed display windows at the moment when these reels stop. Furthermore, the number of medals is also decided by combinations of the symbols, that is, the prize pattern when these reels stop.

A plurality of prize patterns are established in such slot machines. For example, one of the patterns is such that only the number of medals which are paid back, depending on combinations of symbols, is determined by the combination of symbols (for example, there are a plurality of patterns of paying back medals, such as where three fruit picture images are lined up ten medals are paid back).

Furthermore, recently, a novel prize pattern has been disclosed in Japanese Laid-open Patent Publication No. 280872/1996.

In the slot machine, the prize giving decision is determined by sampling a random number, wherein a player is given various prizes according to the result. There are several prize patterns possible, in one of which bonus game is presented to a player depending on a specified combination of symbols, and in the other of which the probability of occurrence of a specified prize pattern occurrence is increased.

As one of the examples of the above-mentioned bonus game,. after a player wins the bonus game prize, the player is granted the right to execute high probability games a fixed number of times (for example, 12 times). In these games, only one medal is inputted to play all the bonus games. That is, during the bonus games, the game machine is controlled so that symbols stop and are displayed so as to obtain a specified combination at a higher probability, wherein an appointed number of medals (for example, 15 medals) can be obtained, and acquisition of a greater number of bonus games leads to acquisition of a greater amount of medals.

In the prize pattern by which such a bonus game is obtained, there are some types, that is, a big bonus (hereinafter B.B.), a regular bonus (R.B.) and a single bonus (S.B.), etc., whereby these can be obtained by combinations of specified symbols. Since there is a chance to obtain a great amount of medals, the probability of occurrence is set to a lower rate according to the number of medals acquired.

Herein, a description is given of one of the examples of S.B., R.B., and B.B.. S.B. permits a high probability game to be performed once after winning the prize S.B.. The R.B. permits a high probability game to be performed 12 times after winning the prize R.B., wherein, in the meantime, when prizes are acquired an appointed number of times (for example, 8 times), the bonus game is finished, and at the same time the R.B. is finished. Furthermore, the B.B. grants a player the right to execute a B.B. game an appointed number of times (for example, 30 times) after winning the first B.B.. Furthermore, if a combination of specified symbols is lined up during the B.B. games, another bonus game (for example, the same bonus games as the R.B.) can be carried out three times.

Acquisition of R.B. and B.B., but especially, B.B. is a chance to obtain a great amount of medals at once. On the other hand, with the S.B., it is not possible to acquire a number of medals at one time. However, there are some types having a prize pattern in which the S.B. occurrence probability is increased by ten times than in the usual case. A status where this S.B. occurrence probability is increased (hereinafter, this status is called "high S.B. probability status") is continued until a status cancellation command is given by random number sampling performed in the respective games. Therefore, S.B. status can be frequently acquired in the S.B. high probability status, wherein it is possible to obtain a great amount of medals until the S.B. high probability status is terminated.

Thus, once the prize acquiring pattern of S.B. high probability status is acquired, there are cases where a greater number of medals than in the case of the B.B. can be obtained if the S.B. high probability status is continued for a long period of time. Therefore, a hit of the S.B. high probability status is a prize pattern which is thought highly of by a player as well as acquisition of B.B., and this status is of great interest to players.

However, in such a slot machine configured as described above, notification of a hit of an S.B. high probability status is effected by, for example, lighting of the display lamp showing the status.

As described above, since a hit of a S.B. high probability status is of great interest to players, players operate a slot machine while paying attention to the display lamp showing a hit of a S.B. high probability status. If so, players will not be able to carefully look at reels on which symbols are disposed, and may lose concentration on the game.

SUMMARY OF THE INVENTION

The present invention was developed in view of the above-mentioned shortcomings, and it is therefore an object of the invention to provide a more interesting game machine without spoiling players' concentration on games.

In order to achieve the above-mentioned object, the invention is characterized in that in a game machine in which prize patterns are decided by combinations of symbols, a status in which appointed prize patterns are likely to occur is signaled to a player by combinations of the above-mentioned. symbols.

Furthermore, the invention is characterized in that, in a game machine in which prize patterns are decided by combinations of symbols, the combinations of symbols which, respectively, become the above-mentioned appointed prize patterns in usual states are made different from those in a status where appointed prize patterns are likely to occur.

Furthermore, the invention is characterized in that in a status where the above-mentioned appointed prize patterns are likely to occur, there exist a plurality of combinations of symbols which become one of the above-mentioned appointed prize patterns.

BRIEF DESCRIPTION OF THE DRAWINGS

FIG. 4A is a view showing a case where the slot machine is in a usual state, that is, is not in the S.B. high probability status, and FIG. 4B is a view showing a case where the slot machine is in the S.B. high probability status; and FIG. 5 is a table showing the relationship between prize patterns, combinations of the symbols and the occurrence probability in a slot machine according to another preferred embodiment of the invention, and the view shows a case of S.B. high probability status.

DETAILED DESCRIPTION OF THE PREFERRED EMBODIMENTS

Figure 1:
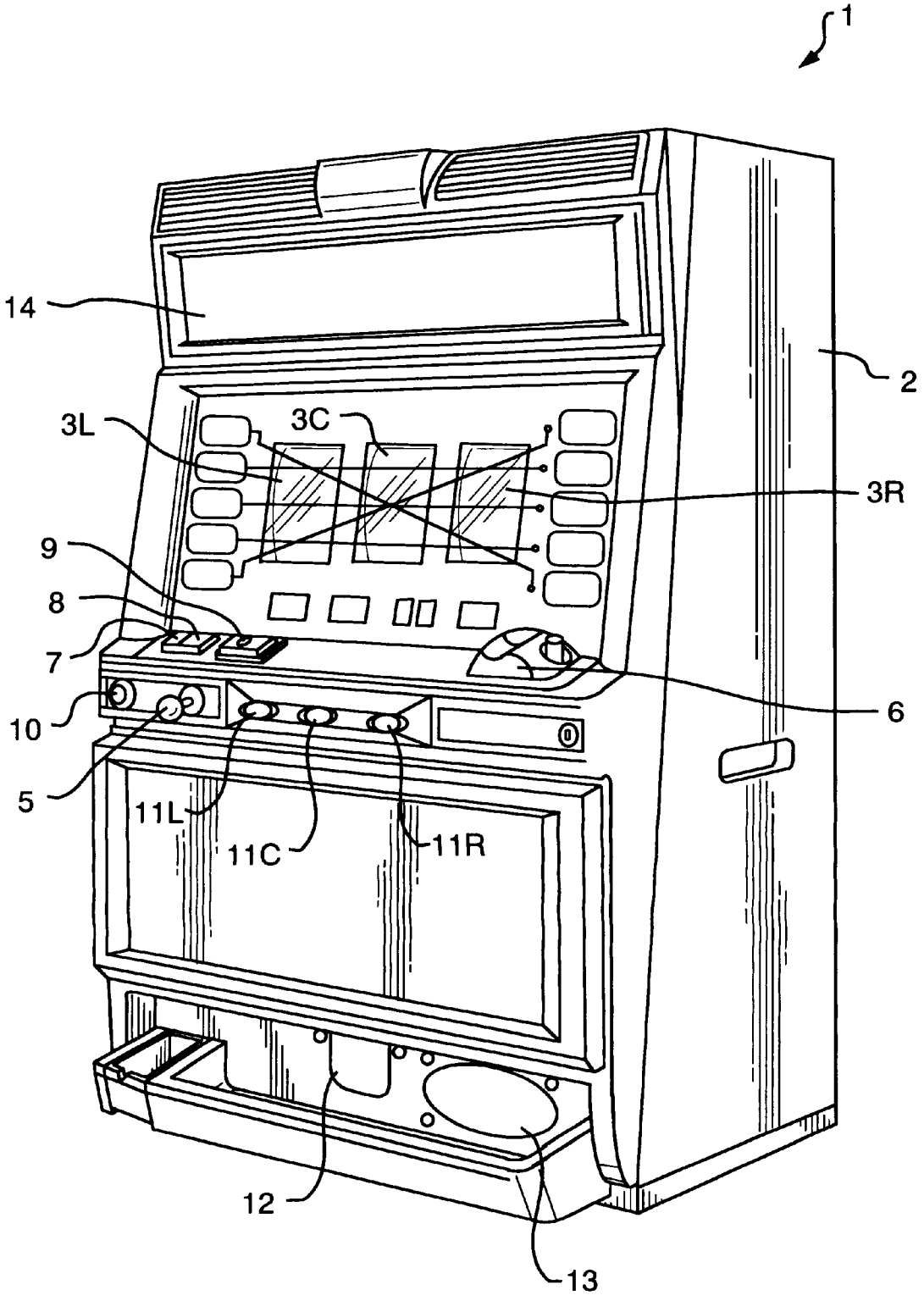
FIG. 1 is an appearance view of a slot machine according to one preferred embodiment of the invention.

FIG. 1 is a figure showing a slot machine according to one preferred embodiment of the invention.

A description is given of the slot machine which is an example of game machines in the preferred embodiment.

In FIG. 1, the slot machine is indicated by 1, wherein, at the front elevational part of cabinet 2 which forms the entirety of the machine 1, display windows 3L, 3C and 3R for observation of the symbols of a plurality of reels (not illustrated) secured in the cabinet 2 are provided so as to correspond to the quantity of reels (three reels in the case of FIG. 1).

Furthermore, prize lines are displayed by, for example, printing on the display windows 3L, 3C and 3R, and prize patterns are decided by combinations of symbols lined up on these prize lines.

Downward of the display windows 3L, 3C and 3R at the front elevation part of the cabinet 2, there are provided a medal input port 6 for inputting medals into the game machine for a stake on the game, a 1-BET switch 7 for staking only one medal of those credited in the slot machine 1 per pressing operation of a pushbutton switch, a 2-BET switch 8 for staking only two medals of those credited in the machine per pressing operation of the pushbutton switch, and a maximum BET switch 9 by which the maximum number of medals stakable per game can be staked per pressing operation of the pushbutton switch.

Further downwards thereof, there are provided a start lever 5 for causing reels to rotate by a player's operation, a pay-out button 10 which is able to switch the play credit and pay out of the medals acquired by a player by a pressing operation of a pushbutton switch, and is used to pay out the credited medals when there is at least one medal as credit, a stop button 11L for stopping rotations of the reel observed through the window 3L, a stop button 11C for stopping rotation of the reel observed through the window 3C, and a stop button 11R for stopping rotation of the reel observed through the window 3R.

A medal pay-out port 12 for paying out medals and a medal reservoir portion 13 for storing medals paid out from the medal pay-out port 12 are disposed at the lower part of the slot machine body 1. Furthermore, an allotment display panel 14 describing combinations of prize symbols and a table of allotment, etc., is provided at the upper part of the front elevation part of the machine 1.

Figure 2:
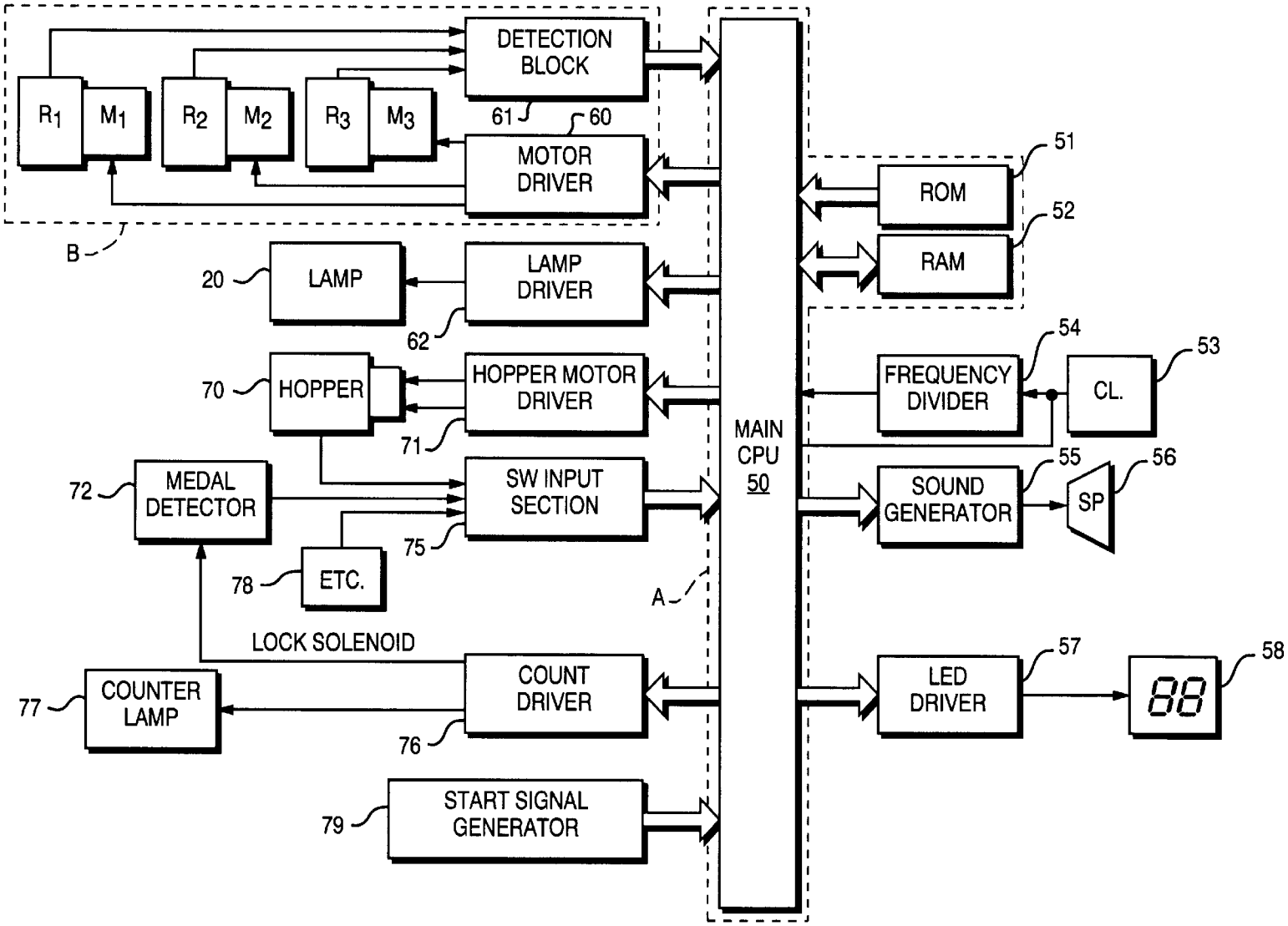
FIG. 2 is a block diagram showing a microcomputer section which controls a slot machine according to the preferred embodiment of the invention.

FIG. 2 is a block diagram showing the microcomputer section which controls the slot machine according to the preferred embodiment.

In FIG. 2, section A indicated by a broken line is the main control section having a main CPU 50, a ROM 51, and a RAM 52. The ROM 51 stores a coordinate table for symbols and symbol codes, a coordinate table of symbol codes corresponding to prizes and the number of medals to be paid out according to prizes, and a table for the prize probability in compliance with the prize patterns in a case where prizes are given to the games executed. Furthermore, the RAM 52 prepares a random number keeper which temporarily stores random numbers to be sampled after a game is commenced, and a memory which temporarily stores data such as code numbers of reels and symbol numbers, etc.

Furthermore, a clock pulse generator is indicated by 53, which generates pulses of, for example, 4 Mhz, and actuates the main CPU 50 by the reference pulse, and a frequency divider is indicated by 54, which gives an interrupt pulse of, for example, 500 Hz to the main CPU 50 in order to insert and execute an appointed interrupt program. A sound generator is indicated by 55, which is driven to generate sounds by a speaker 56 in order to arise interest in a game at an ideal time after a game is commenced. An LED driver is indicated by 57, which drives, for example, a 7-segment digital display light emitting diode 58. This is utilized for a credit quantity display and a gain quantity display.

Furthermore, section B indicated by broken lines is a reel drive monitoring section. In this preferred embodiment, the respective reels R1, R2, and R3 are driven by pulse motors M1, M2 and M3. The motors M1, M2 and M3 are rotated by drive pulses generated by a motor driver 60, wherein, for example, a symbol of a reel which can be observed through each of the windows 3L, 3C and 3R may be rotated so as to slip one by one by one pulse. Furthermore, the respective reels are composed so that a reset signal can be generated per rotation. Detection block 61 detects the reset signal. With the main CPU 50, it is possible to specify which symbolic mark appears on the reels observed through the windows 3L, 3C and 3R, by counting how many drive pulses the motors are given after the detection block 61 detects the reset signals.

Furthermore, a lamp driver is indicated by 62, which lights lamp 20 by an instruction given by the main CPU 50.

Still furthermore, 70 is a hopper for paying out prize medals, and 71 is a hopper motor driver thereof. 72 is a medal detector for detecting input of medals before commencing a game, a signal of the number of medals inputted, which comes from the medal detector 72, is transmitted, together with a signal of the number of medals paid out from the hopper 70, from a count driver 76 to a counter or a lamp 77 via a switch input section 75 and main CPU 50, wherein the numbers of inputted medals and paid out medals are detected, or a display lamp of a prize effective line is caused to go on in compliance with the number of inputted medals. Furthermore, as the number of inputted medals reaches, for example, three medals, a lock solenoid for locking the input of medals is actuated.

Furthermore, 78 is another switch operating section, for example, a discontinuance switch to be operated when discontinuing a game after medals are inputted. 79 is a start signal generator, which consists of, for example, the above-mentioned start lever 5 or maximum BET switch 9, etc.

With the construction described above, a judgement process regarding game progress of a slot machine according to the preferred embodiment is carried out in compliance with appointed execution programs by the main CPU 50.

Here, a description is given of the basic game progress in the preferred embodiment.

In order to start a game and to rotate the reels, a medal to be staked on the game is inputted through the medal input port 6 or the start lever 5 is operated after already credited medals are staked for the game by operating the 1-BET switch. 7, 2-BET switch 8 or the maximum BET switch 9. Furthermore, in a case where the maximum BET switch 9 is operated, it may be constructed so that the reels can be rotated without operating the start lever 5.

Thereafter, lots are drawn to determine a prize pattern in the main CPU 50. The lots with respect to the prize patterns are carried out by, for example, random numbers, and a decision as to which of the prize patterns is performed is made on the basis of a drawn figure of the random numbers. After that, the reel rotation speed is made constant, and the stop buttons 11L, 11C and 11R become effective after many of the prize patterns are viewed, whereby a player may operate the stop buttons 11L, 11C and 11R.

As the player operates the stop buttons 11L, 11C and 11R, the respective reels stop to finish the game. At this time, the results of the random number decision as to the prize patterns previously performed influences the positions at which the respective reels stop.

That is, the reels basically stop at the moment when the stop buttons 11L, 11C and 11R are operated. However, in a case where the prize status is, for example, a blank as the result of the previous lots, the reels are caused to stop so that a combination of the stopped symbols does not results in any prize award even though the stop buttons 11L, 11C and 11R may be operated at any time.

On the other hand, in a case where a certain prize is determined as a result of the previous lots, the reels are stopped at the positions where the determined prize pattern is displayed. At this time, in the case where the position where the prize pattern drawn is noticeably different from the moment when the stop buttons 11L, 11C and 11R are operated, it is unnatural that the reels are stopped at the position where the drawn prize pattern is shown. Therefore, in such a case, the reels are stopped at natural positions. As a result, there are cases where the prize determined by the previous random numbers are different from the combination of symbols at the actual stop position. In this case, it is a matter of course that the combination of the symbols which actually stopped becomes the result of the game.

At the finish of a game, a prize judgement process is carried out, wherein when a certain prize is acquired, medals are paid out. When judging the prizes, a photo sensor is used to detect a photo signal section secured at the respective symbols at the respective reels, in a type where reels are driven by pulse motors, or a signal section is provided at one point of the reels so that a reset pulse is obtained per rotation of the reels, and it is possible to judge the prize on the basis of how many pulse signals are obtained by the pulse motors until the pulse motors stop after generation of the above-mentioned reset pulses is commenced.

Furthermore, when judging the prizes, the combination of symbols is referred to information in the ROM 51 by using the symbols of the respective reels as the above-mentioned symbol codes. In a case where a certain prize is acquired, the hopper motor is driven to pay out the medal prize, and the number of medals to be paid out is counted by, for example, a counter secured halfway at the medal pay-out channel, wherein the number of medals paid out reaches the appointed number, the game is finished.

Next, a description is given of the process to be performed when the S.B. high probability status, which is a feature of the invention, is hit.

Figure 3:
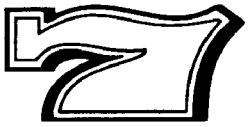
FIG. 3 is a table showing parts of symbols used in a slot machine according to the preferred embodiment of the invention together with the names thereof.
Figure 3:
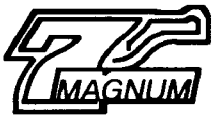
Figure 3:
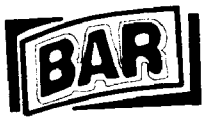

FIG. 3 is a table showing a portion of the symbols used for a slot machine according to the preferred embodiment and the names thereof.

In the preferred embodiment, a description is given, using three types of symbols, SEVEN, MAGNUM SEVEN, and BAR shown in FIG. 3.

FIG. 4 is a table showing the relationship between the prize patterns, i.e., the combination of symbols, and probability of occurrence thereof, in a slot machine according to the preferred embodiment, wherein FIG. 4A is a view showing a usual state, that is a state where the slot machine is not in an S.B. high probability mode, and FIG. 4B is a view showing a status of S.B. high probability.

With reference to FIG. 4A, a description is given of the usual state of the preferred embodiment. First, if a combination of symbols becomes SEVEN-SEVEN-SEVEN in the order of windows 3L, 3C and 3R shown in FIG. 1, the status hits the B.B. prize acquisition pattern. The ratio of occurrence of the prize pattern is 1/200. Furthermore, if a combination thereof become s BAR-BAR-BAR, the status hits the R.B. prize acquisition pattern. The ratio of occurrence of the prize pattern is also 1/200. Furthermore, in a case where a combination of symbols becomes MAGNUM SEVEN-MAGNUM SEVEN-MAGNUM SEVEN, the status hits the S.B. prize acquisition pattern. The ratio of occurrence of the prize pattern is 1/30.

As described above, in a prior art slot machine, in the S.B. high probability status, the ratio of occurrence of the S.B. acquisition is set to ten times higher than that of the usual status. At this time, the combination of symbols which results in S.B. acquisition is the same as that of the usual status. In the example shown in FIG. 4A, the S.B. acquisition state was effected when the combination of symbols became MAGNUM SEVEN-MAGNUM SEVEN-MAGNUM SEVEN even in the S.B. high probability status.

On the contrary, in the preferred embodiment, the combination of symbols to acquire an S.B. prize is made different from that of the usual status, and as shown in FIG. 4B, the S.B. prize is acquired when the combination of symbols becomes SEVEN-MAGNUM SEVEN-MAGNUM SEVEN. At this time, even though the combination of symbols becomes MAGNUM SEVEN-MAGNUM SEVEN-MAGNUM SEVEN by which an S.B. prize is acquired in the usual status, no S.B. high probability status is secured in the usual status.

Thus, by making different the combination of symbols in the S.B. high probability status from that of the usual status, it is possible for a player to recognize the S.B. high probability status with attention paid to the display windows rather than to distracting light indicators.

In the preferred embodiment, as shown in FIG. 4B, since the ratio of occurrence of SEVEN-MAGNUM SEVEN-MAGNUM SEVEN in the S.B. high probability status is one-third, resultantly it is possible for the player to acquire the S.B. prize at a probability ten times higher than that of the usual status in the S.B. high probability status. Furthermore, in a case where an S.B. prize is acquired when a combination of symbols becomes MAGNUM SEVEN-MAGNUM SEVEN-MAGNUM SEVEN during a play, the S.B. high probability status will be cancelled.

As described above, in the preferred embodiment, the combinations to acquire S.B. prizes in the usual status are different from those of the S.B. high probability status, whereby a player can recognize a hit of an S.B. high probability status, continuance and end thereof by simply paying attention to the reels. Therefore, the concentration of a player on a game is not hindered.

Next, a description is given of another preferred embodiment of the invention.

FIG. 5 is a coordinate table for prize patterns, combinations of symbols and probability of occurrence in a slot machine according to the preferred embodiment, which shows an S.B. high probability status.

In this preferred embodiment, the prize patterns in the usual status, that is, a status not being S.B. high probability, are the same as those in FIG. 4A. Therefore, a description of the usual status is omitted.

In this preferred embodiment, there is a plurality of combinations of symbols in which the prize pattern permits S.B. status in the S.B. high probability status. That is, as shown in FIG. 5, in cases where the combinations of symbols are the following ten types in the order of windows 3L, 3C and 3R shown in FIG. 1, that is, MAGNUM SEVEN-MAGNUM SEVEN-MAGNUM SEVEN, SEVEN-MAGNUM SEVEN-MAGNUM SEVEN, SEVEN-SEVEN-MAGNUM SEVEN, BAR-BAR-MAGNUM SEVEN, BAR-MAGNUM SEVEN-MAGNUM SEVEN, MAGNUM SEVEN-BAR-MAGNUM SEVEN, MAGNUM SEVEN-SEVEN-MAGNUM SEVEN, MAGNUM SEVEN-SEVEN-SEVEN, MAGNUM SEVEN-MAGNUM SEVEN-SEVEN, and SEVEN-MAGNUM SEVEN-SEVEN, wherein the S.B. status is enabled.

As regards the ten combinations of symbols in which the S.B. acquisition shown in FIG. 5 is enabled, the ratio of occurrence thereof is, respectively, 1/30. The ratio of occurrence of S.B. acquisition becomes one-third as a whole. Therefore, in this preferred embodiment, it is possible for a player to acquire S.B. at a ratio ten times higher in the S.B. high probability status than in the usual status.

As described above, in the preferred embodiment, the combinations of symbols, which enable an S.B. status, in the usual status are made different from those in the S.B. high probability status, whereby a player can recognize a hit of an S.B. high probability status, continuance and end thereof by only paying attention to the reels. Therefore, the concentration of a player on a game is not hindered.

Furthermore, in the preferred embodiment, as regards the ten combinations of symbols which enable an S.B. acquisition, the ratio of occurrence thereof is made uniform to be 1/30. However, the present invention is not limited to this ratio. It may be possible to set various types of ratios of occurrence for each of the combinations of symbols.

Furthermore, in each of the preferred embodiments described above, a description was given of the slot machine in which reels are rotated. However, the invention is not limited to this type of game machine. For example, it may be applicable to a slot machine in which symbols are displayed.

Furthermore, although, in each of the preferred embodiments described above, a description was given of a case where the prize patterns are determined on the basis of combinations of three types of symbols, the invention is not limited to this type. It may be applicable to a slot machine in which the prize patterns are determined by combinations of symbols excepting three marks.

As described above, according to the invention, it is possible for a player to recognize a hit of the S.B. high probability status by only paying attention to the reels, wherein the concentration onto the game is not hindered. Therefore, it is possible to sustain the interest of a player in a game until the game is finished.

Furthermore, according to the invention, it is possible to provide a more interesting slot machine than ever, in which a player keeps his mind on the games.

What is claimed is:

1. A game machine comprising:

a first combination of symbols on a plurality of symbol indicators indicating a first status associated with a probability of occurrence of an appointed prize pattern; and a second combination of symbols on the plurality of symbol indicators different from said first combination of symbols indicating a change in said first status to a second status, said change in said status being that there is a change in said probability of occurrence of said appointed prize pattern;

wherein the first and second combinations of symbols are displayed on the same set of symbol display reels.

2. A game machine as set forth in claim 1, wherein said appointed prize pattern at said second status is indicated by one of a plurality of combinations of symbols on the plurality of symbol indicators.

3. The game machine of claim 2, wherein said plurality of combinations of symbols on the plurality of symbol indicators indicating said appointed prize pattern at said second status is different from said combination of symbols on the plurality of symbol indicators indicating said first status.

4. The game machine of claim 3, wherein said first status indicated by the combination of symbols on the plurality of symbol indicators indicates a probability of occurrence that is less than a probability of occurrence indicated by said second status.

5. The game machine of claim 3, wherein said first and second status indicated by the combination of symbols on the plurality of symbol indicators are indicated by a set of one or more reels included in said game machine.

6. The game machine of claim 1, wherein said appointed prize pattern at said second status is indicated by only one combination of symbols on the plurality of symbol indicators.

7. A method of indicating change in a probability of occurrence of a prize pattern in a game machine comprising:

indicating a usual status probability of occurrence of an appointed prize pattern by a first combination of symbols on a plurality of symbol indicators and;

indicating a high probability status of occurrence of said appointed prize pattern by a second combination of symbols on the plurality of symbol indicators different from said first combination;

wherein the first and second combinations of symbols are displayed on the same set of symbol display reels.

8. The method as set forth in claim 7, wherein said high probability status of said appointed prize pattern is indicated by one of a plurality of combinations of symbols on the plurality of symbol indicators.

9. The method of claim 8, wherein said plurality of combinations of symbols on the plurality of symbol indicators indicating said appointed prize pattern at said usual status is different from said plurality of combinations of symbols on the plurality of symbol indicators indicating said high probability status.

10. The method of claim 9, wherein said usual status and said high probability status are indicated by the plurality of symbol indicators comprising a set of reels in the game machine.

11. The method of claim 7, wherein said high probability status of said appointed prize pattern is indicated by only one combination of symbols on the plurality of symbol indicators.

* * * * *